US005908124A

United States Patent [19]

Klauke et al.

[11] Patent Number: 5,908,124

[45] Date of Patent: Jun. 1, 1999

[54] ONE PIECE BLOW MOLDED PLASTIC SQUEEZE TUBE WITH AN INTEGRAL TWIST OFF CLOSURE

[75] Inventors: Christian W. Klauke, Toledo; Rolf C. Myers, Graytown; Luz Rios, Genoa, all of Ohio

[73] Assignee: Owens-Brockway Plastic Products Inc., Toledo, Ohio

[21] Appl. No.: 08/963,074

[22] Filed: Nov. 3, 1997

[51] Int. Cl.[6] ..... B65D 1/02; A61J 1/06

[52] U.S. Cl. ..... 215/48; 215/42; 222/107; 222/541.9; 264/516; 264/523

[58] Field of Search ..... 215/14, 40, 42, 215/46, 47, 48, 49, 250, 252, 901; 222/541.9, 541.6, 107; 264/516, 512, 523, 524

[56] References Cited

U.S. PATENT DOCUMENTS

| | | | |
|---|---|---|---|
| 3,356,244 | 12/1967 | Witchell | 215/49 |
| 3,721,360 | 3/1973 | Collie | 215/49 |
| 3,949,871 | 4/1976 | Christensen et al. | 222/107 X |
| 3,993,223 | 11/1976 | Welker, III et al. | 222/541.9 X |
| 4,207,990 | 6/1980 | Weiler et al. | 215/47 X |
| 4,248,227 | 2/1981 | Thomas | 215/49 X |
| 4,979,630 | 12/1990 | Rose et al. | 215/47 |
| 4,995,519 | 2/1991 | Rose et al. | 215/47 |
| 5,054,267 | 10/1991 | Dundas | 215/47 X |
| 5,076,452 | 12/1991 | Hashimoto | 215/48 |
| 5,188,250 | 2/1993 | Kovacic et al. | 215/48 |
| 5,431,292 | 7/1995 | Culter et al. | 215/48 |

FOREIGN PATENT DOCUMENTS

| | | | |
|---|---|---|---|
| 196288 | 10/1986 | European Pat. Off. | 222/541.9 |

*Primary Examiner*—Stephen K. Cronin
*Assistant Examiner*—Nathan Newhouse

[57] ABSTRACT

A plastic tube with an integral finish and a twist off tab are blow molded. The twist off tab is connected to the finish of the tube by an annular groove forming a line of weakness. The tab is formed by the closing of mold halves about an extruded parison to form a flat twist off tab connected by a thin membrane to the exterior of the finish. The tab is then blow molded to form the tube. After the mold halves are opened, the twist-off tab is trimmed to provide the finished tube. The tab is formed by a conventional blow molding process without the need of a secondary operation. A plurality of blow molded corrugations are provided between annular blow molded ribs on the finish and provide added strength to the finish to facilitate removal of the tab.

6 Claims, 3 Drawing Sheets

ONE PIECE BLOW MOLDED PLASTIC SQUEEZE TUBE WITH AN INTEGRAL TWIST OFF CLOSURE

BACKGROUND AND SUMMARY OF THE INVENTION

This invention relates to plastic tubes.

In squeeze tubes, it is common to use a separate closure. However, this requires additional costs incurred in the manufacture of the closure and the equipment for applying the closure.

Among the objectives of the present invention are to provide a one piece blow molded plastic squeeze tube with an integral twist off closure; wherein the tube may be a multilayer tube; wherein the entire package comprising the plastic tube and integral twist off closure tab are blow molded; and wherein the added costs of manufacturing a separate closure and applying a closure are eliminated.

In accordance with the invention, a plastic tube with an integral finish and a twist off tab are blow molded. The twist off tab is connected to the finish of the tube by an annular groove forming a line of weakness. The tab is formed by the closing of mold halves about an extruded parison to form a flat twist off tab connected by a thin membrane to the exterior of the finish. The parison is then blow molded to form the tube. After the mold halves are opened, the twist-off tab is trimmed to provide the finished tube. The tab is formed by a conventional blow molding process without the need of a secondary operation. A plurality of blow molded corrugations are provided between annular blow molded ribs on the finish and provide added strength to the finish to facilitate removal of the tab.

DETAILED DESCRIPTION OF THE PREFERRED EMBODIMENT

Figure 1:
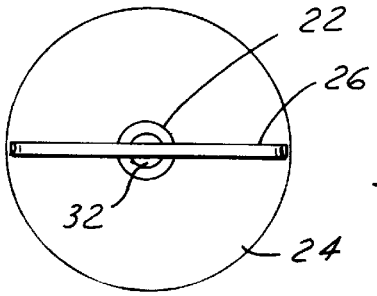
FIG. 1 is a plan view of a plastic tube with an integral finish and a twist-off tab embodying the invention.
Figure 2:
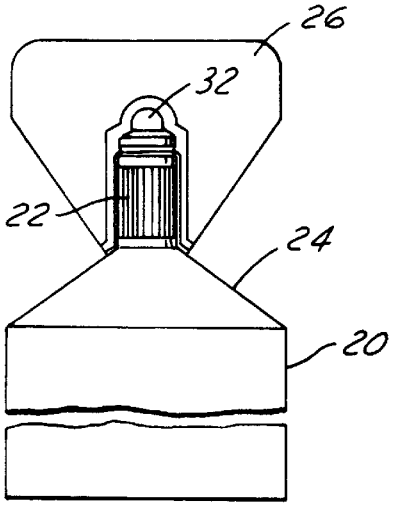
FIG. 2 is a fragmentary front elevational view.
Figure 3:
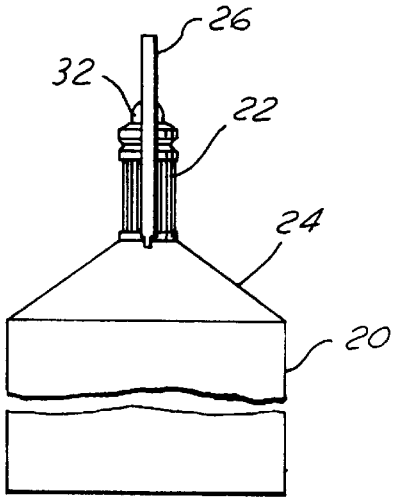
FIG. 3 is a fragmentary side elevational view.
Figure 4:
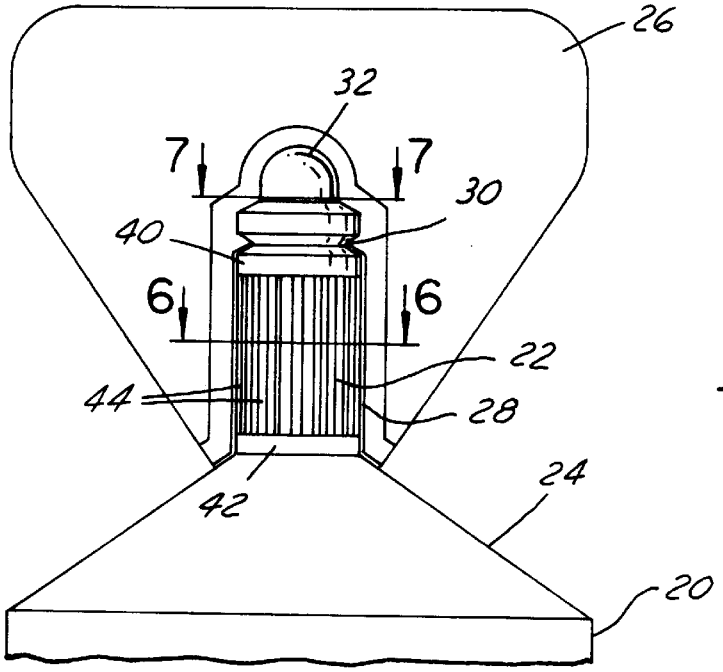
FIG. 4 is a fragmentary enlarged elevational view.
Figure 5:
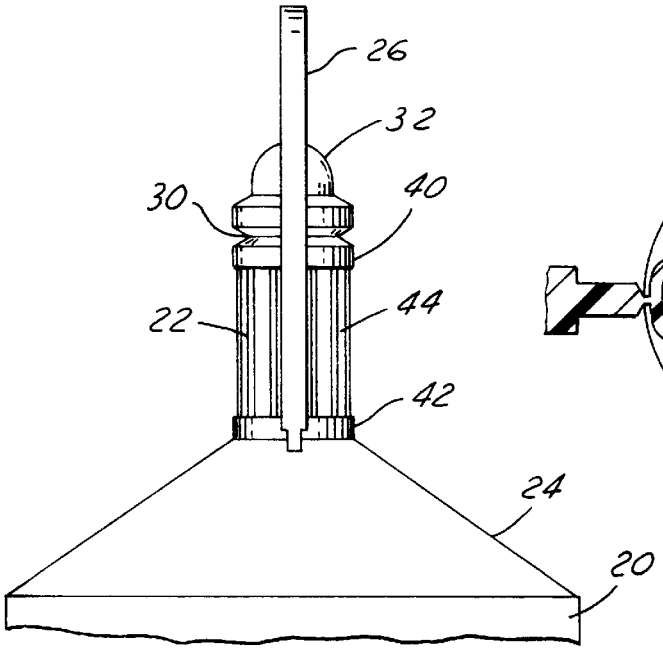
FIG. 5 is aa fragmentary side elevational view of FIG. 4.
Figure 6:
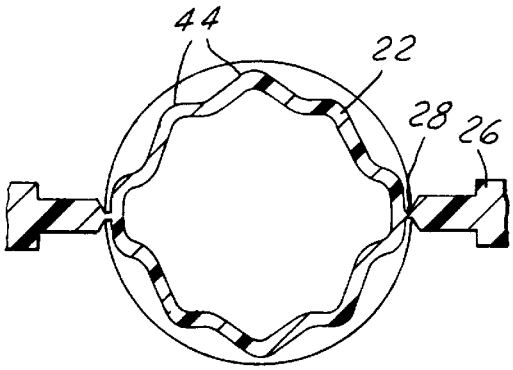
FIG. 6 is a sectional view taken along the line 6—6 in FIG. 4.
Figure 7:
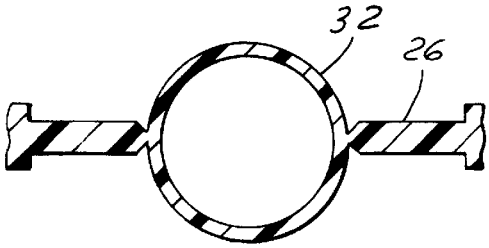
FIG. 7 is a sectional view taken along the line 7—7 in FIG. 4
Figure 8:
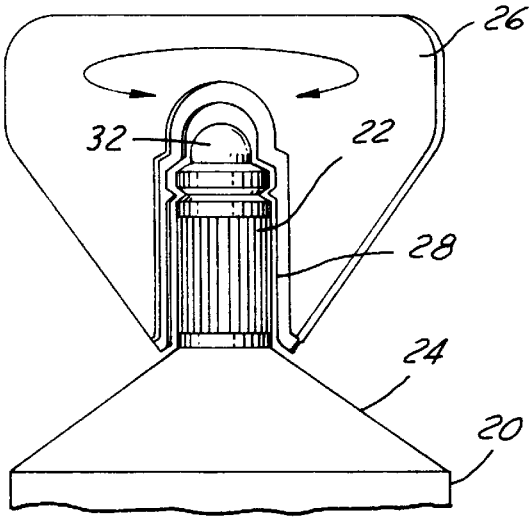
FIG. 8 is a view similar to FIG. 5 showing the tab being severed.
Figure 9:
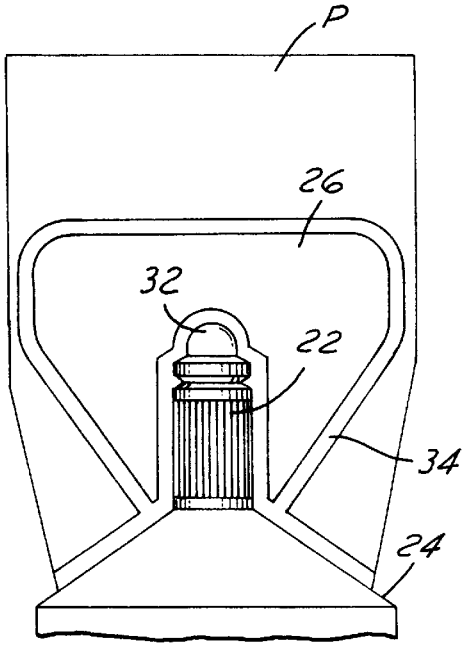
FIG. 9 is a fragmentary view similar to FIG. 4 showing the plastic tube prior to being trimmed.

Referring to FIGS. 1–9, the one piece blow molded plastic squeeze tube 20 with an integral twist off closure embodying the invention is made by extrusion blow molding from a parison, wherein blow mold halves are closed about an extruded parison to form a hollow plastic container with an integral finish and an integral twist off tab. The container is preferably blow molded from the lower end and then trimmed by removing the lower portion through which the container has been blown by trimming the bottom of the container to form a squeezable plastic tube 20 with an integral finish 22 connected to the tube 20 by a neck 24. During the closing of the blow mold halves, a portion of the extruded parison compresses a portion of the tube into an integral tab 26 which is connected to the neck 24 and finish 22 by an integral thin membrane 28. The blow molding also defines a groove 30 defining a line of weakness of an integral closure plug 32 that closes the opening in the finish on tab 26 between the tab 26 and finish 22. The groove 30 is preferably formed by annular flat sides at an angle of about 45°. As shown in FIG. 9, before trimming of the tab 26, the tab 26 is connected to a compressed portion P and neck 24 by a thin membrane 34.

The finish 22 is formed with axially spaced blow molded flanges 40,42 and axially blow molded corrugations 44. The flanges 40,42 and corrugations 44 rigidify the finish 22 and provide a means for strengthening the finish to facilitate twisting the tab 26.

The plastic squeeze tube 20 is filled from its lower end and the end is then closed as by heat sealing the lower end of tube 20. When it is desired to access the contents, the user grips tab 26 and rotates it relative to tube 20 to sever the tab with the plug 32 along the groove 30 and the membrane 28.

Figure 10:
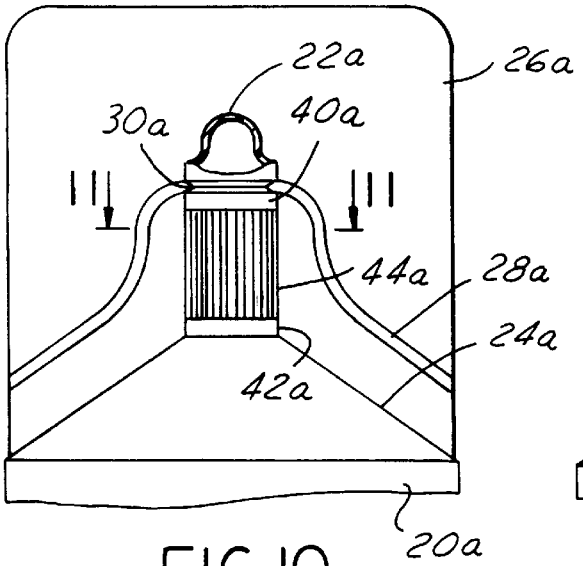
FIG. 10 is a fragmentary view similar to FIG. 4 showing a modified form of tube.
Figure 12:
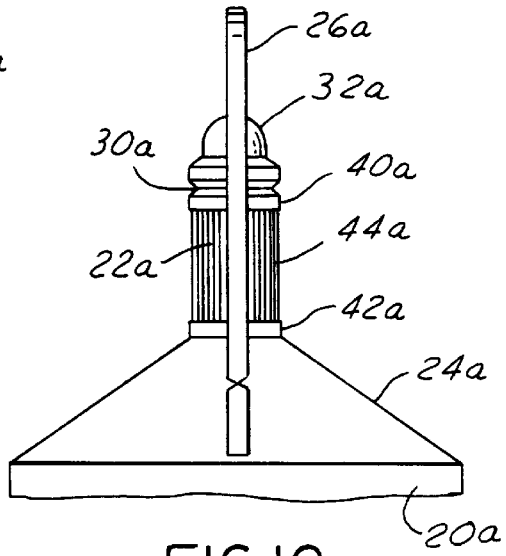
FIG. 12 is a side elevational view of the tube shown in FIG. 10.
Figure 11:
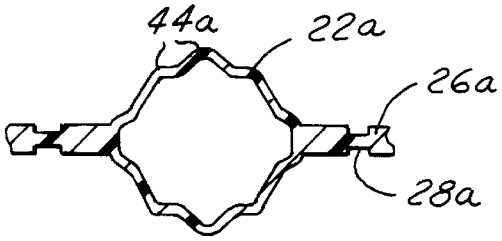
FIG. 11 is a sectional view taken along the line 11—11 in FIG. 10.

In the modified form shown in FIGS. 10–12, the tab 26*a* has a different shape. Otherwise corresponding parts are identified with the suffix "a".

In accordance with the invention, the container and neck may be made of a single layer of plastic or coextruded multiple layers. Coextruded multiple layers permit the package to be filled with products which require barrier layers such as EVOH.

It can thus be seen that there has been provided a plastic tube with an integral finish and a twist off tab which are blow molded. The twist off tab is connected to the finish of the tube by an annular groove forming a line of weakness. The tab is formed by the closing of molds about an extruded parison to form a flat tab connected by a thin membrane to the exterior of the finish. A plurality of blow molded corrugations are provided between blow molded annular ribs on the finish and provide added strength to the finish to facilitate removal of the tab. The tab is formed by a conventional blow molding process without the need of a secondary operation.

We claim:

1. A hollow plastic container comprising a blow molded squeezable body portion including a neck portion, an integral finish, a twist off tab including an integral closure formed integrally with the finish and connected thereto by an annular groove forming a line of weakness, blow molded means on said finish rigidifying said finish, including a pair of blow molded axially spaced annular flanges and a plurality of circumferentially spaced blow molded axial corrugations extending between said flanges for strengthening the finish below the line of weakness against torsion applied to remove said tab.

2. The hollow plastic container set forth in claim 1 including a thin membrane connecting said twist off tab and said finish and extending to said annular groove.

3. The hollow plastic container set forth in claim 1 wherein said twist off tab is connected to said neck portion and said finish by a thin membrane.

4. The method of forming a plastic tube comprising extruding a plastic parison, closing mold halves about said parison, blow molding said parison to form a plastic container, an integral finish on said container, an integral twist off tab including an integral plug connected to said finish and closing an opening in said finish connected thereto by an annular groove providing a line of weakness and integral blow molded strengthening means on said finish including a pair of axially spaced flanges and a circumferential array of corrugations that extend axially between said flanges.

5. The method set forth in claim 4 wherein said step of blow molding forms a thin membrane connecting said twist off tab and said finish and extending to said annular groove.

6. The method set forth in claim 4 wherein said step of blow molding forms a neck between said finish and the container and a thin membrane connecting said twist off tab with said finish and said neck.

* * * * *